US006671990B1

(12) United States Patent
Booth

(10) Patent No.: US 6,671,990 B1
(45) Date of Patent: Jan. 6, 2004

(54) RIFLE HANDGUARD SYSTEM WITH SINGLE END ATTACHMENT

(76) Inventor: Vern H. Booth, 4515 W. Gelding Dr., Glendale, AZ (US) 85306

( * ) Notice: Subject to any disclaimer, the term of this patent is extended or adjusted under 35 U.S.C. 154(b) by 0 days.

(21) Appl. No.: 10/075,744

(22) Filed: Feb. 13, 2002

(51) Int. Cl.[7] ..... F41A 21/00
(52) U.S. Cl. ..... 42/75.01
(58) Field of Search ..... 42/75.01, 75.02

(56) References Cited

U.S. PATENT DOCUMENTS 5,198,600 A * 3/1993 E'Nama ..... 42/90
5,590,484 A * 1/1997 Mooney et al. ..... 42/111
5,826,363 A * 10/1998 Olson ..... 42/75.01
6,293,040 B1 * 9/2001 Luth ..... 42/75.01
6,321,477 B1 * 11/2001 Watson, Jr. ..... 42/75.02

* cited by examiner

*Primary Examiner*—Michael J. Carone
*Assistant Examiner*—Denise J Buckley
(74) *Attorney, Agent, or Firm*—Parsons & Goltry; Robert A. Parsons; Michael W. Goltry

(57) ABSTRACT

A handguard system for use on a rifle having a barrel attached to a receiver by a barrel nut, including an adapter ring and a tubular handguard. The adapter ring is receivable about a barrel nut and changeable between a rotatable configuration where it is rotatably about the barrel nut, and a fixed configuration wherein it is fixed to the barrel nut. The tubular handguard is receivable about a barrel and has an end received about the adapter ring with only the end of the tubular handguard fixedly secured to the adapter ring.

17 Claims, 5 Drawing Sheets

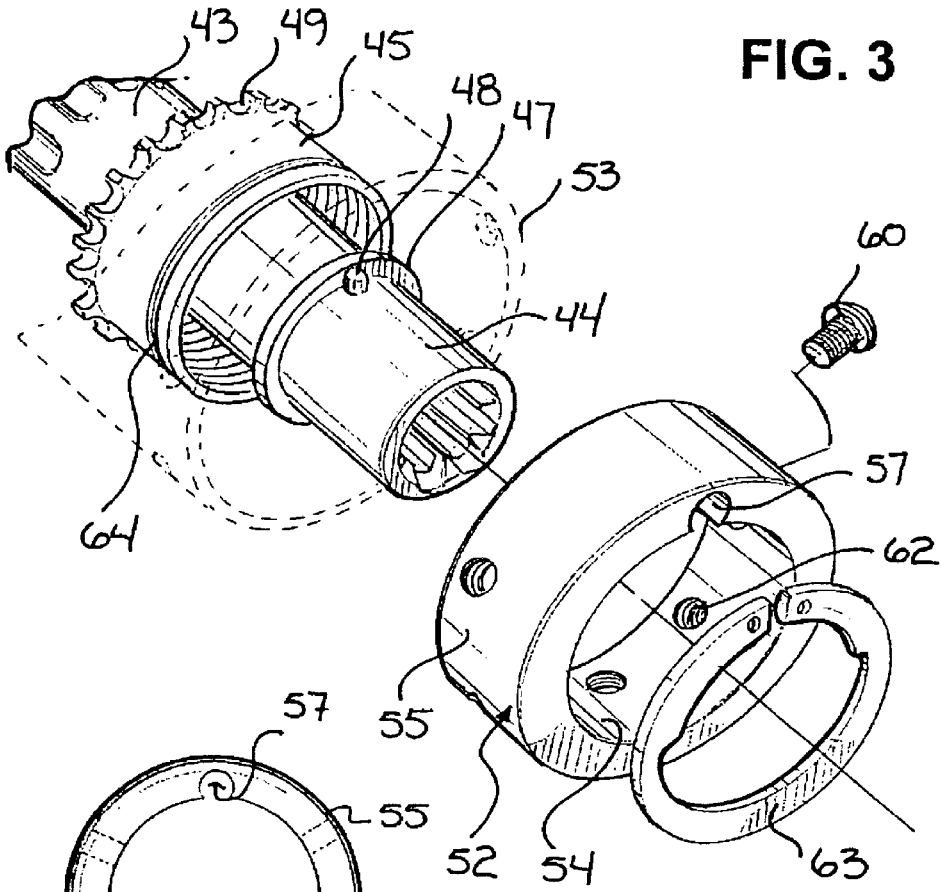
FIG. 3
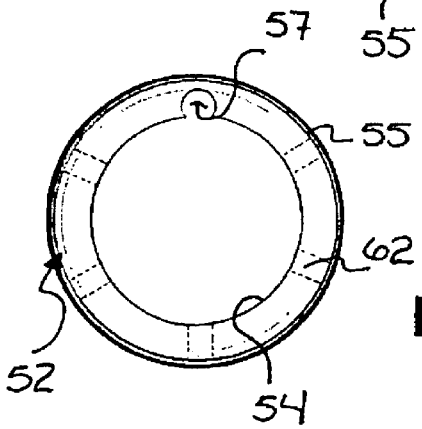
FIG. 4
FIG. 5
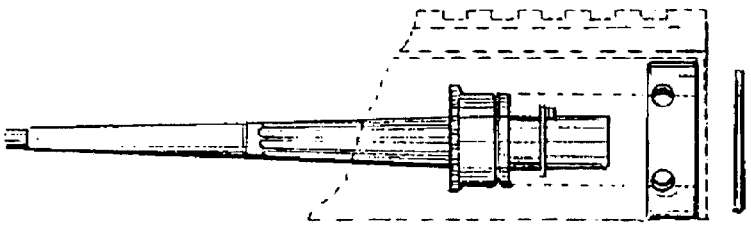

RIFLE HANDGUARD SYSTEM WITH SINGLE END ATTACHMENT

FIELD OF THE INVENTION

This invention relates to rifle accessories.

More particularly, the present invention relates to handguards for rifles.

BACKGROUND OF THE INVENTION

Long guns, and in particular rifles, have long been known. Rifles, due to their length, are typically fired using two hands. One hand is placed proximate the trigger assembly and the other is typically placed down the barrel from the trigger assembly. Rifles conventionally include a stock fabricated of wood. The stock typically includes a fore stock which extends some distance down the barrel. The fore stock is grasped by the shooter to provide balance and facilitate aiming the rifle. The shooter's hand is protected from the heat of the barrel during firing by the fore stock. Many modern rifles often employ synthetic materials for the stock, and still employ a fore stock. Other rifles do not include a single stock, but have a receiver to which a butt stock and a barrel are attached. The hand of a shooter is protected from the barrel by a handguard attached to the barrel. The M16 with its various permutations is an example of this type of rifle.

In an M16, a handguard consists of an upper and a lower handguard fitted around the barrel and attached thereto at both ends. While effective for protecting the hand of a shooter, pressure on and from the handguard can cause minor flexing of the barrel. Flexing or distortion of the barrel can cause sighting problems and bullet deflections, each of which is detrimental to accuracy.

It would be highly advantageous, therefore, to remedy the foreging and other deficiencies inherent in the prior art.

Accordingly, it is an object of the present invention to provide a new and improved handguard system with attachment at only one end.

Another object of the invention is to provide a handguard system which can be employed on existing rifles.

And another object of the invention is to provide a handguard system that is easily installed and aligned.

And yet another object of the invention is to provide a handguard system which will improve accuracy.

SUMMARY OF THE INVENTION

Briefly, to achieve the desired objects of the instant invention in accordance with a preferred embodiment thereof, provided is a handguard system for use on a rifle having a barrel attached to a receiver by a barrel nut. The hand guard system includes an adapter ring and a tubular handguard. The adapter ring is receivable about a barrel nut and changeable between a rotatable configuration wherein the adapter ring is rotatably receivable about a barrel nut, and a fixed configuration wherein the adapter ring is fixedly receivable about a barrel nut. The tubular handguard has an end and is receivable about a barrel and received about the adapter ring with only the end of the tubular handguard fixedly secured to the adapter ring.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 3 is an exploded perspective view of the handguard system of FIG. 2, according to the present invention;

FIG. 4 is an end view of the adapter ring of the handguard system of FIGS. 2 and 3;

FIG. 5 is a partial side view of the barrel assembly of FIG. 2 illustrating the hand guard according to the present invention;

DETAILED DESCRIPTION OF THE PREFERRED EMBODIMENT

Figure 1:
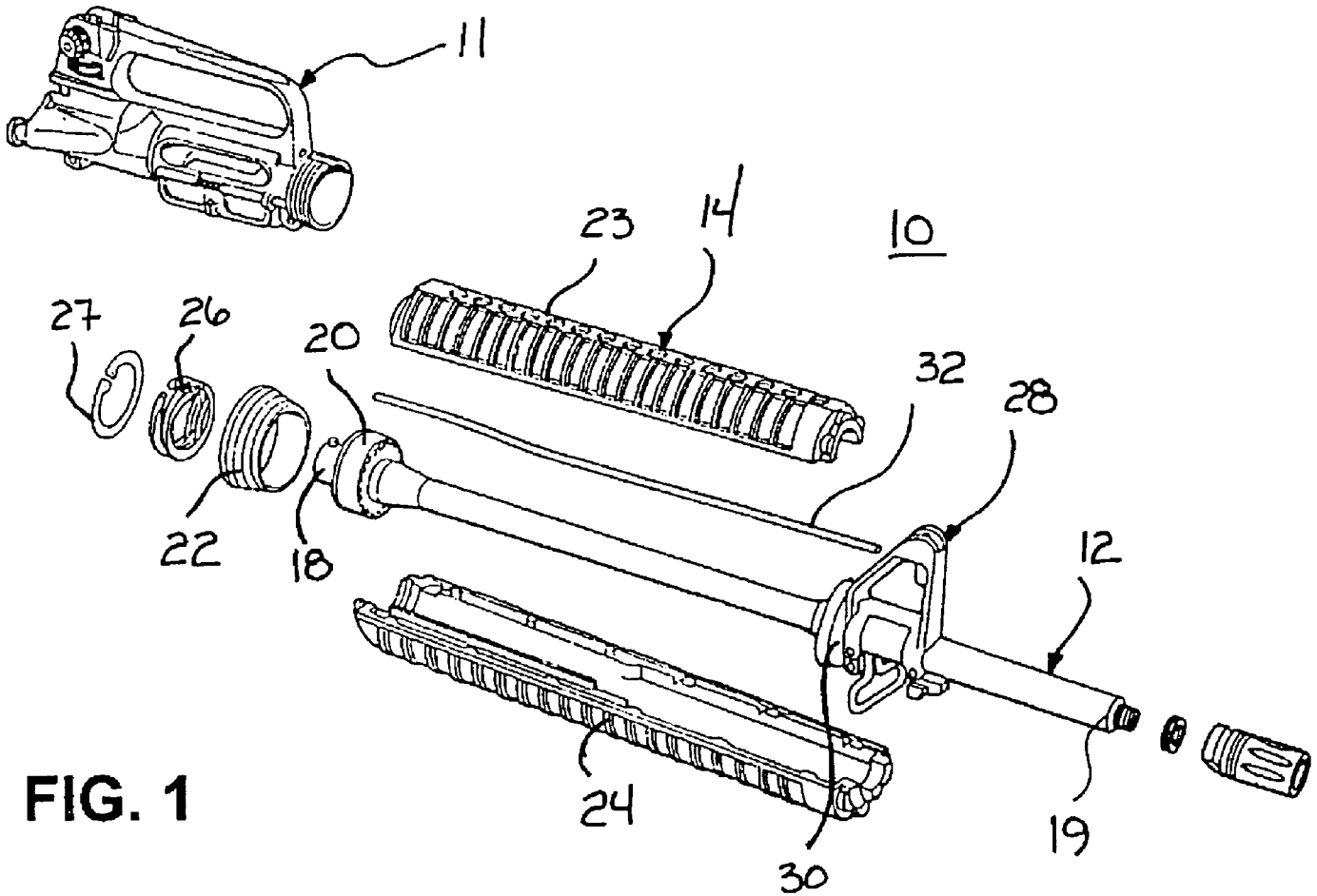
FIG. 1 is an exploded perspective view illustrating an upper receiver and barrel assembly of an M16A1 rifle.

Turning now to the drawings in which like reference characters indicate corresponding elements throughout the several views, attention is first directed to FIG. 1 which is a partial exploded view of a rifle 10 of the type referred to as an M16A1, illustrating an upper receiver 11, a barrel 12 and a handguard system 14. Barrel 12 has a base end 18 and a muzzle end 19. Handguard system 14 is used to cover barrel 12 intermediate base end 18 and muzzle end 19 to provide a comfortable grip and to provide protection for a shooter's hand from the heat of barrel 12 during firing. Base end 18 of barrel 12 is attached to upper receiver 11 by a barrel nut 20.

A spring loaded delta ring 22 fits over barrel nut 20 and is part of handguard system 14 for retaining an upper handguard 23 and a lower hand guard 24. Delta ring 22 is biased forwardly, toward muzzle end 19 of barrel 12 by a spring 26 and retaining ring 27. A front sight assembly 28 is fixed to barrel 12 proximate muzzle end 19 and includes a tube cap 30. The grip halves are fitted between delta ring 22 and tube cap 30. Insertion and removal is accomplished by forcing delta ring 22 rearwardly, against the bias, increasing the separation between delta ring 22 and tube cap 30. Ends of upper handguard 23 and lower hand guard 24 are inserted into delta ring 22, and the opposing ends are received by tube cap 30. Delta ring 22 is then permitted to return to the normal forward position, securing upper handguard 23 and lower hand guard 24. A gas tube 32 extends along barrel 12 between an operating mechanism carried by upper receiver 11 and tube cap 30. Gas tube 32 extracts gas from barrel 12 after firing and redirects it back to the operating mechanism.

While somewhat effective, attachment of both ends of the grip to the barrel can distort the accuracy of the rifle. Pressure or torque by the shooter on the hand guard translates directly into pressure on the barrel. Additionally, heating of the handguard by heat form the barrel can cause expansion of the handguard. Distortion of the handguard can put pressure on the barrel. Any pressure can flex the barrel, even to the slightest degree, which will cause a sighting error and deflection of the bullet.

Figure 2:
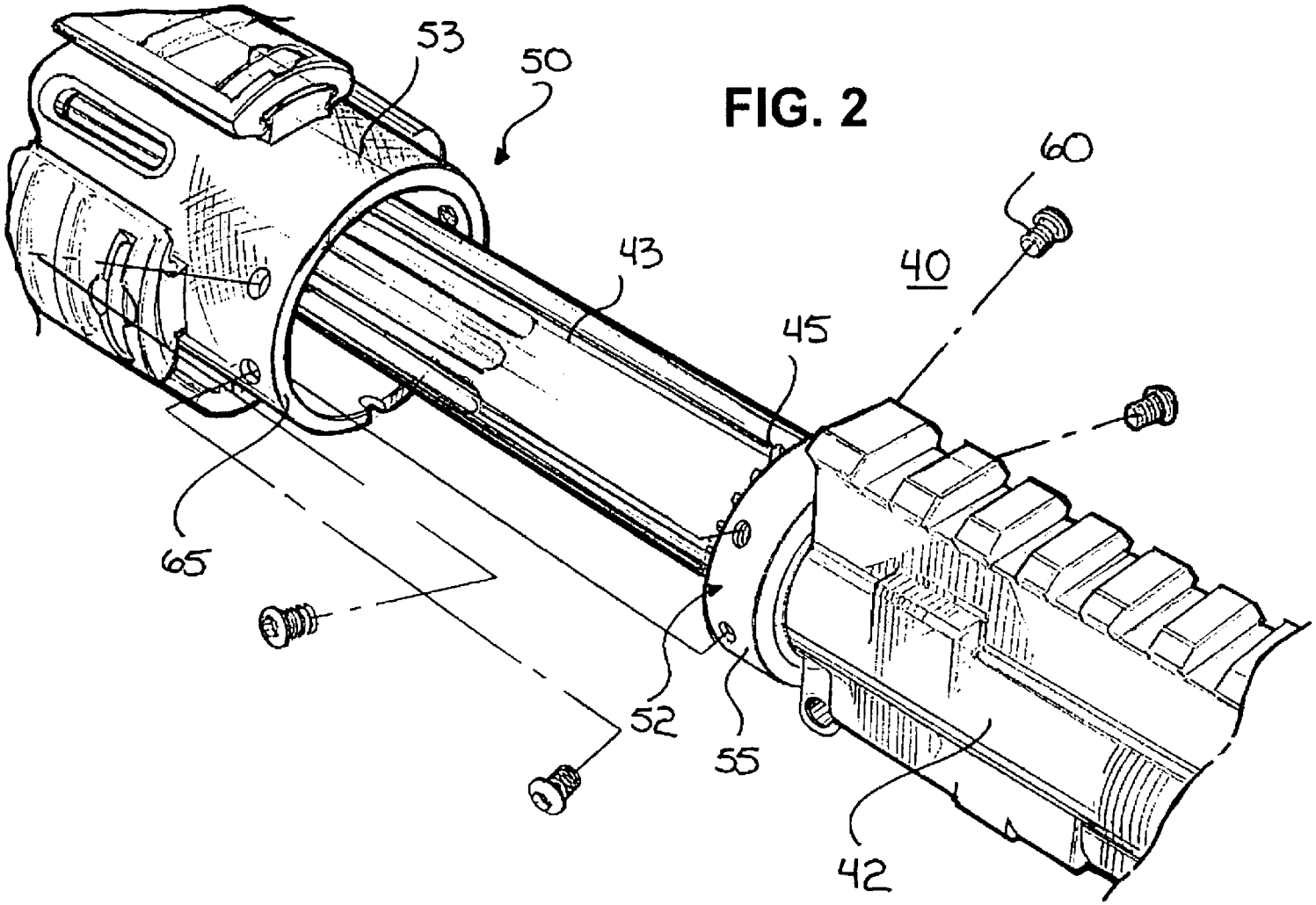
FIG. 2 is a exploded perspective view of the rifle of FIG. 1 with portions of the barrel and upper receiver illustrated, showing the conventional handguard replaced by a handguard system according to the present invention.

Turning now to FIGS. 2 and 3, a portion of a rifle 40 is illustrated. Rifle 40 is illustrated as an M16A1, but it will be understood that other rifles similar to that described above can be modified with a handguard system according to the present invention, generally designated 50. A portion of an upper receiver 42 is illustrated with a barrel 43 having a base end 44 attached to upper receiver 42 by a conventional barrel nut 45. A flange 47 extends around the outer circumference of barrel 43 proximate base end 44 of barrel 43 against which barrel nut 45 abuts. An alignment pin 48 extends from barrel 43 proximate flange 47 to facilitate proper alignment of barrel 43 when base end 44 is inserted into upper receiver 42. When barrel 43 is properly inserted and aligned, barrel nut 45 is threaded into upper receiver 42 and engages flange 47, securely holding barrel 43 in position. Barrel nut 45 includes a plurality of grooves 49 formed about its outer periphery. Grooves 49 provide space through which a gas tube passes, refer to gas tube 32 of FIG. 1. Since barrel nut 45 must be threaded onto upper receiver 42, the plurality of grooves 49 insures one will align properly.

Still referring to FIGS. 2 and 3, handguard system 50 includes an adapter ring 52 and a generally tubular handguard 53. Adapter ring 52 includes an inner surface 54 defining an inner diameter, an outer surface 55 defining an outer diameter and a gas tube passage 57 extending longitudinally therethrough. The inner diameter of inner surface 54 is sized to be rotatably received about barrel nut 45. Adapter ring 52 is rotatable to permit alignment of gas tube passage 57 with alignment pin 48 and the proper groove 49 to receive a gas tube. Once properly positioned, adapter ring 52 is secured by fasteners, such as set screws 60 inserted through radially extending apertures 62 (FIG. 4), and tightened against barrel nut 45. Thus, adapter ring 52 is changeable between a rotatable configuration and a fixed configuration. With additional reference to FIG. 5, adapter ring 52 can be rotatably coupled to barrel nut 45 by a retaining ring 63 inserted into a channel 64 formed in barrel nut 45, thus retaining adapter ring 52 intermediate grooves 49 and retaining ring 63. Other examples of the rotatable configuration could include adapter ring 52 threadably received by the barrel nut. The threads allow rotation of the adapter ring for adjustment. The adapter ring can be changed to the fixed configuration by employing an adhesive or like compound. In this case, retaining ring 63 is unnecessary.

Referring specifically to FIG. 2, once adapter ring 52 is secured in position in the fixed configuration, tubular handguard 53 is received about barrel 43. Handguard 53 has an end 65 defining an inner diameter slightly larger than the outer diameter of adapter ring 52. End 65 is received about outer surface 55 of adapter ring 52 and secured thereto by a plurality of fasteners such as headed screws extending through apertures formed in handguard 53. Handguard 53 is attached such that it is spaced from barrel 43 and attached only at adapter ring 52. In this manner, a handguard is provided which is attached only at end 65 and thus will not deflect or put pressure on the barrel.

Figures 6, 8:
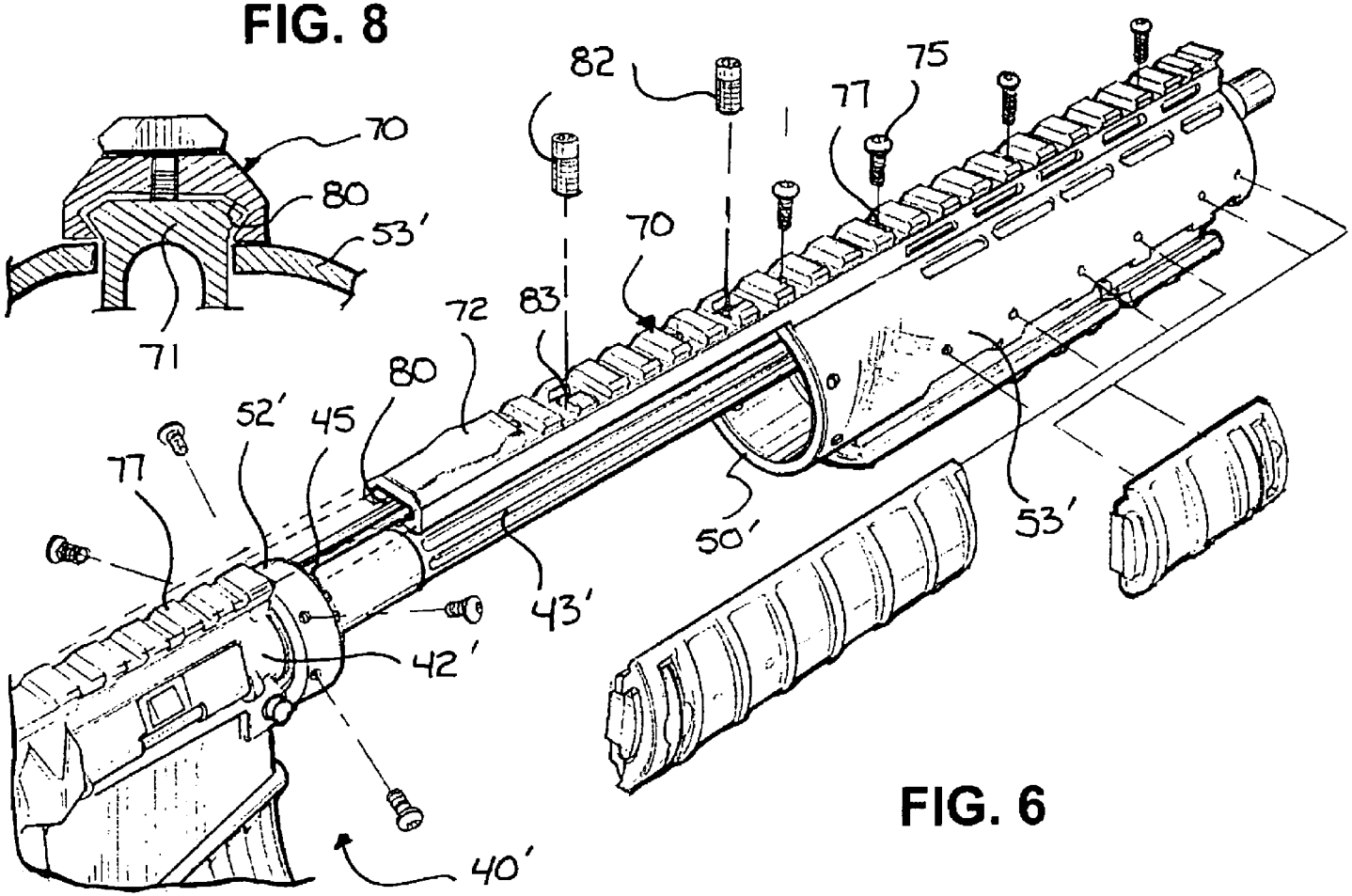
FIG. 6 is a partially exploded perspective view illustrating a portion of a rifle with a rail extension according to the present invention.
FIG. 8 is sectional view taken along line 8—8 of FIG. 7.
Figure 7:
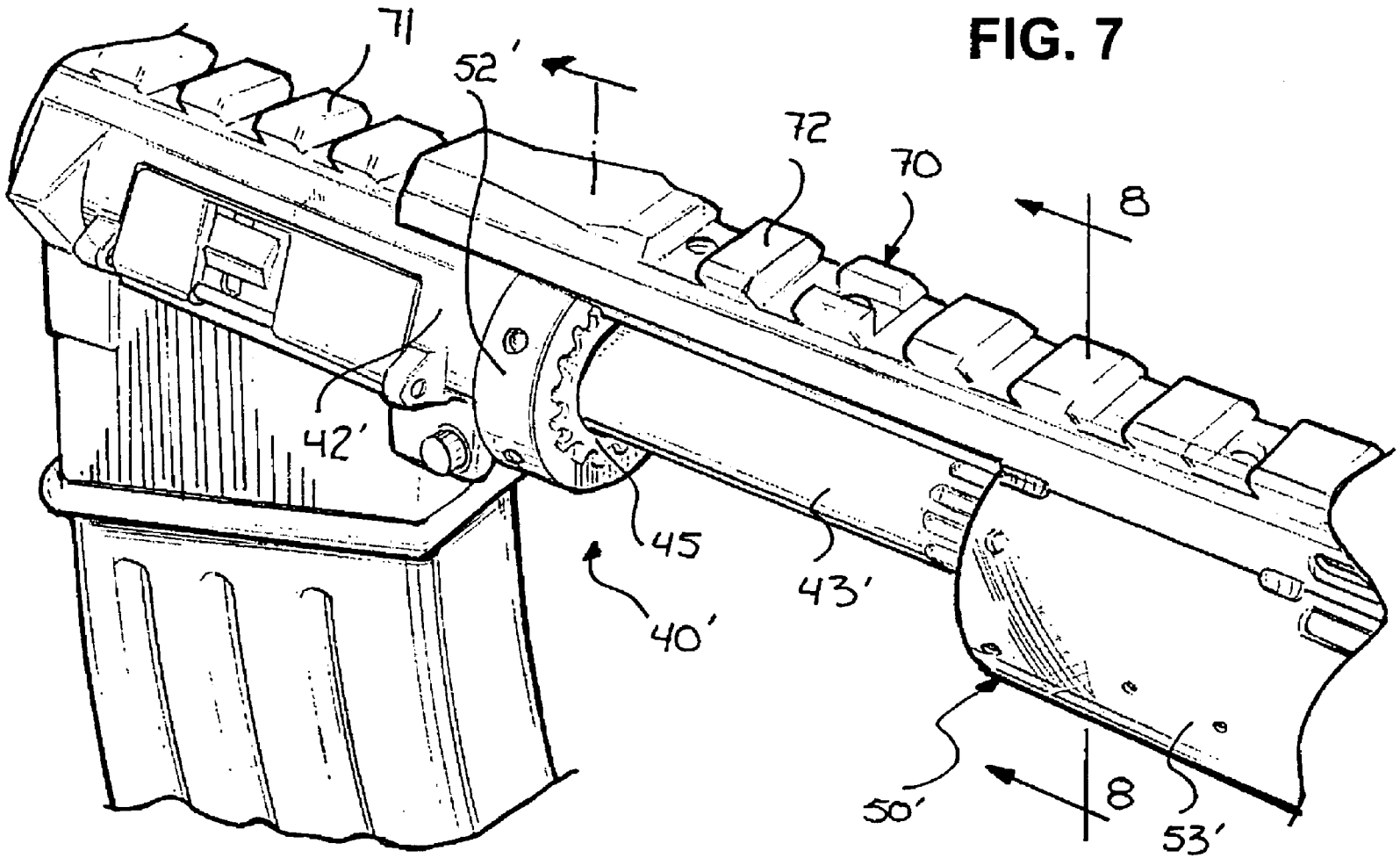
FIG. 7 is a perspective view of the rail extension being positioned over the rail on an upper receiver of a rifle.

Turning now to FIGS. 6 and 7, another embodiment of the present invention, including a rail extension generally designated 70, is illustrated. A portion of a rifle 40' is illustrated. Rifle 40' is illustrated as an M16A1, but it will be understood that other rifles similar to that described above can be modified with a rail extension according to the present invention. A portion of an upper receiver 42' is illustrated with a barrel 43' attached thereto by a conventional barrel nut 45'. A handguard system 50', including an adapter ring 52' and a generally tubular handguard 53', as described previously, is coupled to rifle 50'. In this embodiment, upper receiver 42' includes a rail portion 71 on an upper surface. Rail portion 71 is employed for the attachment of various accessories such as sights, scopes, etc. Often, however, the existing rail on upper receiver 42' is too short for many purposes. Thus, extension rail 70 can be employed to extend the rail down barrel 43' along handguard 53'.

Extension rail 70 is fastened to the top of cylindrical handguard 53' with a receiver portion 72 extending outwardly past end 65'. Extension rail 70 can be fastened to handguard 53' in many diverse ways, but is preferably attached using screws 75 extending through apertures 77 into handguard 53'. As handguard 53' is received over barrel 43', receiver portion 72 of extension rail 70 is fitted over rail 71. As can be seen with additional reference to FIG. 8, receiver portion 72 of extension rail 70 is formed with an underside defining a dovetail slot 80. Slot 80 is shaped to receive rail 71 therein. Receiver portion 72 of extension rail 70 is preferably of a length substantially identical to the length of rail 71. In this manner, when handguard 53' is correctly positioned, receiver portion 72 of extension rail 70 substantially covers rail 71. Receiver portion 72 of extension rail 70 is fastened to rail 71 with set screws 82 extending through apertures 83 and engaging the top of rail 71. While extending the rail, extension rail. 70 additionally acts to reinforce and help stabilize handguard 53'.

It will be understood by one skilled in the art that while extension rail 70 is illustrated and described in combination with handguard system 50', it can be used with other handguard attachment systems. For example, a tubular handguard having a threaded end which is threaded onto a barrel nut or other ring can also benefit from the extension rail. In this instance, the handguard is installed first and the extension rail is slipped over the existing rail and then fastened to the handguard and existing rail.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A handguard system for use on a rifle having a barrel attached to a receiver by a barrel nut, the hand guard system comprising:

an adapter ring receivable about a barrel nut and changeable between a rotatable configuration wherein the adapter ring is rotatably receivable about a barrel nut, and a fixed configuration wherein the adapter ring is fixedly receivable about a barrel nut; and a tubular handguard having an end, the tubular handguard receivable about a barrel and received about the adapter ring with only the end of the tubular handguard fixedly secured to the adapter ring.

2. A handguard system as claimed in claim 1 wherein the adapter ring includes a gas tube passage for permitting the passage of a gas tube therethrough.

3. A handguard system as claimed in claim 1 wherein the adapter ring includes an inner surface defining an inner diameter larger than an outer diameter of the barrel nut and an outer surface defining an outer diameter smaller than an inner diameter of the end of the tubular handguard.

4. A handguard system as claimed in claim 1 wherein the adapter ring is changeable to the fixed configuration by a plurality of fasteners extending radially through the adapter ring and engagable with the barrel nut.

5. A handguard system as claimed in claim 4 wherein the fasteners are set screws.

6. A handguard system as claimed in claim 1 further including fasteners received through the end of the tubular handguard for engaging the adapter ring and fixedly securing the tubular handguard thereto.

7. A handguard system as claimed in claim 6 wherein the fasteners are headed screws.

8. A handguard as claimed in claim 1 wherein the adapter ring is couplable to the barrel nut by a retaining ring receivable within a channel formed around an outer surface of the barrel nut.

9. A handguard system comprising:

an upper receiver;

a barrel having a base end and a muzzle end;

a barrel nut attaching the base end of the barrel to the receiver;

an adapter ring received about the barrel nut and changeable between a rotatable configuration wherein the adapter ring is rotatably received about the barrel nut, and a fixed configuration wherein the adapter ring is fixedly received about the barrel nut; and a tubular handguard having an end, the tubular handguard encircling the barrel and received about the adapter ring with only the end of the tubular handguard fixedly secured to the adapter ring.

10. A handguard system as claimed in claim 9 wherein the adapter ring includes a gas tube passage through which a gas tube extends.

11. A handguard system as claimed in claim 9 wherein the adapter ring is changeable to the fixed configuration by a plurality of fasteners extending radially through the adapter ring and engaged with the barrel nut.

12. A handguard system as claimed in claim 9 further including fasteners received through the end of the tubular handguard, engaging the adapter ring and fixedly securing the tubular handguard thereto such that the handguard is spaced from the barrel and attached only at the adapter ring.

13. A handguard as claimed in claim 9 wherein the adapter ring is coupled to the barrel nut by a retaining ring received within a channel formed around an outer surface of the barrel nut.

14. A method of installing a handguard system, comprising the steps of:

providing a rifle having a barrel attached to a receiver by a barrel nut;

providing an adapter ring having a gas tube passage therethrough;

placing the adapter ring about the barrel nut in a rotatable configuration;

rotating the adapter ring to align the gas tube passage with a gas tube;

fixing the adapter ring to the barrel nut in a fixed configuration;

providing a tubular handguard having an end;

sliding the tubular handguard over the barrel and received about the adapter ring; and securing the end of the tubular handguard to the adapter ring.

15. A method as claimed in claim 14 wherein the step of placing the adapter ring about the barrel nut in a rotatable configuration includes a step of rotatably coupling the adapter ring to the barrel nut by placing a retaining ring within a channel formed around an outer surface of the barrel nut.

16. A method as claimed in claim 14 wherein the step of fixing the adapter ring includes engaging the barrel nut with fasteners extending through the adapter ring.

17. A method as claimed in claim 14 wherein the step of securing the end of the handguard to the adapter ring includes engaging the adapter ring with fasteners extending through the handguard such that the handguard is spaced from the barrel and attached only at the adapter ring.

* * * * *